US007946293B2

(12) United States Patent
Gerardi

(10) Patent No.: US 7,946,293 B2
(45) Date of Patent: May 24, 2011

(54) CIGARETTE LIGHTER AND METHOD

(75) Inventor: Anthony Richard Gerardi, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 415 days.

(21) Appl. No.: 12/127,959

(22) Filed: May 28, 2008

(65) Prior Publication Data

US 2009/0293891 A1 Dec. 3, 2009

(51) Int. Cl.

| | |
|---|---|
| ***A24F 13/00*** | (2006.01) |
| ***A24F 47/00*** | (2006.01) |
| ***A24F 3/00*** | (2006.01) |
| ***A24F 13/02*** | (2006.01) |
| ***F23Q 7/00*** | (2006.01) |
| ***F23Q 2/32*** | (2006.01) |
| ***H05B 3/58*** | (2006.01) |

(52) U.S. Cl. ..... 131/329; 131/328; 131/185; 131/187; 219/260; 219/535; 431/253

(58) Field of Classification Search ..... 131/187, 131/194, 185, 328; 431/253, 258; 219/260, 219/535

See application file for complete search history.

(56) References Cited

U.S. PATENT DOCUMENTS

| | | | | |
|---|---|---|---|---|
| 2,002,492 | A * | 5/1935 | Dess | 219/214 |
| 3,526,751 | A * | 9/1970 | Climent | 219/267 |
| 3,863,047 | A | 1/1975 | Mase | |
| 4,140,003 | A | 2/1979 | Pillsbury, Jr. et al. | |
| 4,342,902 | A * | 8/1982 | Ping | 219/268 |
| 4,621,649 | A * | 11/1986 | Osterrath | 131/185 |
| 4,780,062 | A | 10/1988 | Yamada et al. | |
| 4,806,081 | A | 2/1989 | Harmsen et al. | |
| 5,223,695 | A | 6/1993 | Merchel et al. | |
| 5,388,594 | A | 2/1995 | Counts et al. | |
| 5,424,929 | A | 6/1995 | Murray et al. | |
| 5,591,368 | A | 1/1997 | Fleischhauer et al. | |
| 5,708,258 | A | 1/1998 | Counts et al. | |
| 5,921,757 | A | 7/1999 | Tsutsui et al. | |
| 5,954,979 | A | 9/1999 | Counts et al. | |
| 6,152,725 | A | 11/2000 | Lee | |
| 6,615,840 | B1 | 9/2003 | Fournier et al. | |
| RE38,260 | E | 10/2003 | Wong | |
| 6,632,082 | B1 | 10/2003 | Smith | |
| 6,695,136 | B1 * | 2/2004 | Torres | 206/88 |
| 7,214,055 | B2 | 5/2007 | Meister et al. | |
| 7,338,280 | B2 | 3/2008 | Wong | |
| D569,546 | S * | 5/2008 | Silcox | D27/142 |
| 2002/0005207 | A1 * | 1/2002 | Wrenn et al. | 131/194 |
| 2007/0089488 | A1 | 4/2007 | McDonough et al. | |

* cited by examiner

*Primary Examiner* — Richard Crispino
*Assistant Examiner* — Dionne W Mayes
(74) *Attorney, Agent, or Firm* — Brinks Hofer Gilson & Lione

(57) ABSTRACT

A lighter for a smoking article is provided, which includes a body having a distal body portion and a proximal body portion; an ignition element disposed in the distal portion; a smoking article engagement structure disposed in the proximal body portion; a part of the proximal body portion that is configured for exerting a vacuum upon a smoking article retained by the smoking article engagement structure; and an exhaust port in fluid communication with the part of the proximal body portion that is configured for exerting a vacuum. A method is also provided, which includes the steps of: providing a lighter including a distal ignition means and a proximal means for exertion of a vacuum upon a smoking article; placing a smoking article with its lighting end proximate the distal ignition means and its mouth end in fluid communication with the proximal means for exertion of a vacuum; actuating the proximal means for exertion of a vacuum and the distal ignition means until the lighting end is ignited; and removing the smoking article from the lighter for consumption by a smoker.

24 Claims, 3 Drawing Sheets

CIGARETTE LIGHTER AND METHOD

FIELD OF THE INVENTION

Aspects of the present invention are directed to cigarette lighters, and more particularly to cigarette lighters having an electrical heating element.

BACKGROUND

Popular smoking articles, such as cigarettes, have a substantially cylindrical rod shaped structure and include a charge, roll, or column of smokable material such as shredded tobacco (e.g., in cut filler form) surrounded by a paper wrapper thereby forming a so-called "smokable rod" or "tobacco rod." Normally, a cigarette has a cylindrical filter element aligned in an end-to-end relationship with the tobacco rod. Typically, a filter element comprises cellulose acetate tow plasticized using triacetin, and the tow is circumscribed by a paper material known as "plug wrap." A cigarette can incorporate a filter element having multiple segments. Typically, the filter element is attached to one end of the tobacco rod using a circumscribing wrapping material known as "tipping paper," in order to provide a so-called "filtered cigarette." It also has become desirable to perforate the tipping material and plug wrap, in order to provide dilution of drawn mainstream smoke with ambient air. Descriptions of cigarettes and the various components thereof are set forth *Tobacco Production, Chemistry and Technology*, Davis et al. (Eds.) (1999).

Normally, a generally cylindrical or rod-shaped smoking article, such as a cigarette, has a generally circular cross-sectional shape, and each of the lighting tip and mouth end faces thereof extend virtually perpendicular to the longitudinal axis of that cigarette. A cigarette typically is employed by a smoker by lighting one end thereof and burning the tobacco rod. The smoker then receives mainstream aerosol (e.g., smoke) into his/her mouth by drawing on the opposite end (e.g., the filter or mouth end) of the cigarette.

Similarly several different configurations are known for cigarette lighters. One common example uses a fuel such as liquid butane, a controlled stream of which changes to a gas phase upon being released from a pressurized container and is ignited by an electric spark or flint generated spark to sustain a flame. Another common example uses liquid naphtha which is transported through a wick in a lighter to a site for ignition by an electric spark or flint generated spark to sustain a flame. Still another common example is an electric lighter, which typically has a coil or other shape of a wire with high resistance, which—when electric current is passed therethrough—gets sufficiently hot to ignite a cigarette. With each of these three lighter configurations, a user/smoker facilitates lighting by drawing mainstream aerosol though the cigarette into his/her mouth while applying a flame or heated lighter surface to the lighting end of the cigarette for a time sufficient to establish self-sustaining flame. This is commonly referred to as "lighting puff."

With regard to smoking articles such as cigarettes, certain attempts have been made to alter the nature or character of smoke generated by cigarettes through the positioning of various components or component materials near the lighting ends or tip portions of cigarettes. In one regard, a cigarette having a paper wrapped tobacco rod may include ingredients (e.g., ammonium salts or tobaccos having relatively high ammonia levels) located at its tip portion that corresponds to its lighting end. See, for example, U.S. Pat. No. 6,874,508 to Shafer et al. and U.S. Pat. App. Pub. No. 2005/0022829 to Atwell et al., which are incorporated herein by reference.

Likewise, attempts have been made to alter the nature or character of smoke by positioning components near the mouth end of cigarettes. See, for example, U.S. Pat. No. 3,494,366 to Starbuck et al., entitled, "Cigarette Having Heat Sink Means For Removing Impurities From Cigarette Smoke." In another smoking article, the geometric configuration of the lighting end may be modified from the traditional flat-faced cylinder (see, e.g., U.S. patent application Ser. No. 11/868,264, to Borschke, et al.).

In yet another regard, certain types of cigarettes, such as those marketed commercially under the brand names "Premier" and "Eclipse" by R.J. Reynolds Tobacco Company, have incorporated combustible fuel sources (e.g., carbonaceous fuel elements) that generate heat for the production of a smoke-like aerosol. See, for example, the types of smoking articles set forth in U.S. Pat. No. 4,793,365 to Sensabaugh et al.; U.S. Pat. No. 5,183,062 to Clearman et al.; and U.S. Pat. No. 5,551,451 to Riggs et al.; and U.S. Patent Application Publication Nos. 2007/0023056 to Cantrell et al.; 2007/0215167 to Crooks et al.; and 2007/0215168 to Banerjee et al.; each of which is incorporated herein by reference.

The concentration of mainstream aerosol constituents changes on a puff-by-puff basis starting with the lighting puff and progressing down the rod. It would be desirable to provide a manner or method for providing alteration of the overall composition of mainstream aerosol generated by a cigarette, particularly in the first puffs. In particular, it may be desirable to selectively reduce a user's contact (e.g., by inhalation or ingestion) with certain compounds that are known to occur at higher concentrations in the first puff or two upon lighting a smoking article.

BRIEF SUMMARY OF THE INVENTION

The present invention relates to an apparatus for lighting (i.e., igniting) smoking articles, and in particular, to a lighter configured for lighting generally rod-shaped smoking articles, such as cigarettes. A smoking article comprises a lighting end or tip (i.e., an upstream end), and a mouth end (i.e., a downstream end).

In another aspect, certain embodiments of the present invention may include a lighter for a smoking article, which includes a body having a distal body portion and a proximal body portion; an ignition element disposed in the distal portion; a smoking article engagement structure disposed in the proximal body portion; a part of the proximal body portion that is configured for exerting a vacuum upon a smoking article retained by the smoking article engagement structure; and an exhaust port in fluid communication with the part of the proximal body portion that is configured for exerting a vacuum.

In still another aspect, embodiments of the present invention may include another lighter for a smoking article, which includes a body having a distal body portion and a proximal body portion that are longitudinally positionable relative to each other; an ignition element disposed in the distal portion; a smoking article engagement structure disposed in the proximal body portion; and an exhaust port member that includes a mouthpiece element that is connected with the proximal body portion and is in fluid communication with the smoking article engagement structure as well as being configured for exertion of a vacuum upon a smoking article retained by the smoking article engagement structure.

In yet another aspect, embodiments of the present invention may include a method of lighting a smoking article. One example of a method includes the steps of: providing a lighter including a distal ignition means and a proximal means for exertion of a vacuum upon a smoking article; placing a smoking article with its lighting end proximate the distal ignition means and its mouth end in fluid communication with the proximal means for exertion of a vacuum; actuating the proximal means for exertion of a vacuum and the distal ignition means until the lighting end is ignited; and removing the smoking article from the lighter for consumption by a smoker.

Smoke constituent reduction for one or more puffs of a smoking article may be achieved by providing a lighter with an electrical heating element rather than an open flame, and contact with those constituent compounds by a smoker may be reduced in particular by providing and using a lighter of the present invention. Aspects of the present invention thus address the needs identified above and provide significant advantages as further discussed herein.

DETAILED DESCRIPTION OF EMBODIMENTS OF THE INVENTION

Figure 1:
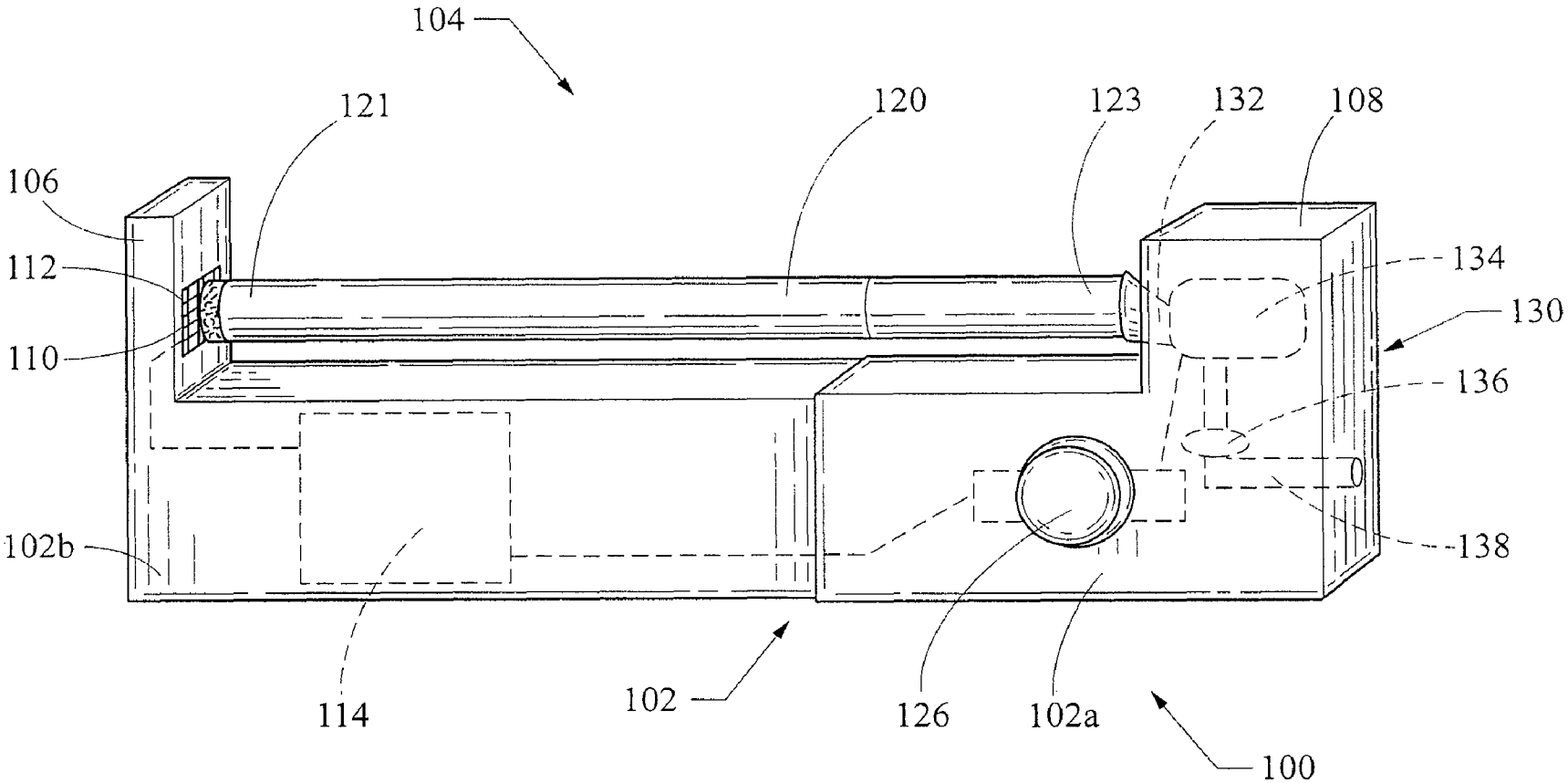
FIG. 1 is a perspective view of a first cigarette lighter embodiment.

The present invention now will be described more fully below with reference to the accompanying drawings, in which some, but not all aspects of the invention are shown. Indeed, the present invention may be embodied in many different forms, including in different proportions than those illustrated in the drawings which are not to scale, and should not be construed as limited to the aspects set forth herein; rather, these aspects are provided so that this disclosure will satisfy applicable legal requirements. Those of skill in the art will appreciate that features of the different embodiments disclosed herein may be used in different combinations than specifically illustrated while remaining within the scope of the present invention.

FIG. 1 shows a first embodiment of a cigarette lighter 100. Although the term "cigarette lighter" is used throughout, those of skill in the art will appreciate that a device of the present invention may be configured for use with cigars, cigarillos, or other smoking articles within the scope of the present invention. The lighter 100 includes a 2-piece body 102 having a first body portion 102*a* and a second body portion 102*b*. The first and second body portions 102*a*, 102*b* preferably are longitudinally positionable (e.g., slidable) relative to each other in a manner configured to allow a user to change the length of the lighter 100 to accommodate smoking articles of different lengths. (As used herein, the term "user" refers to an adult smoker.) For example, some cigarettes are commonly about 85 mm in length, while others are about 100 to 120 mm in length. Those of skill in the art will appreciate that the first and second body portions 102*a*, 102*b* may be frictionally engaged, they may be biased relative to each other by a spring or other resilient component, or they may include a graduated/stepwise or non-graduated/stepwise graduated/stepwise mechanism configured for adjusting the overall device length and particularly the length of a cigarette-receiving region 104 between upward-extending end portions of the body portions 102*a*, 102*b*.

The cigarette-receiving region 104 is disposed between an upward-extending distal part 106 of the second body portion 102*b* and an upward-extending proximal part 108 of the first body portion 102*a*. The upward-extending distal part 106 includes an ignition element 110 configured as an electrical lighting element including an electro-resistant wire element 112 connected to a power source 114 (shown diagrammatically in FIG. 1; preferably a DC power source such as, for example, a battery disposed inside the second body portion 102*b*). In one embodiment, the first and second body portions 102*a*, 102*b* may be connected in part by a spring or other elastic member (not shown, but a variety of mechanisms will be obvious to those of skill in the art) that will bias them toward each other in a manner configured to help retain the cigarette therebetween, and to maintain a desirable contact pressure between the ignition element 110 and the lighting end 121 of a cigarette 120.

In alternative embodiments, butane, naphtha, or other type of ignition means (e.g., laser, radiant element, or even a match) may be used for the ignition element, but an electrical ignition element is preferred for the present application. Examples of ignition means that may be used within the scope of the current invention may include, for example, one or more of those disclosed in U.S. Pat. Nos. 3,863,047; 4,140,003; 5,223,695; 5,388,594; 5,424,929; 5,591,368; 5,708,258; 5,954,979; 6,152,725; 6,615,840; 6,632,082; 7,214,055; 7,338,280; or RE38,260, or in U.S. Pat. App. Pub. No. 2007/0089488.

The adjustable-length feature is useful in one aspect for allowing use of the lighter 100 with different lengths of cigarette. In another aspect, the lighter 100 may be used to relight a smoking article that was previously lit and therefore has a shorter length than a standard machine-manufactured or hand-crafted smoking article. This application may be selected by a user for the same reason as initial lighting of a smoking article (e.g., one or more of just lighting the cigarette, reducing the user's contact with certain mainstream aerosol components that are higher in a "first puff"). Alternatively, a user may elect to use the lighter 100 for a "relight" because he/she does not like the flavor upon lighting of partially-combusted smoking material.

The first body portion 102*a* includes an exhaust system 130. The exhaust system 130 preferably includes a cigarette-engagement member 132, a fan member 134, a filter member 136 and an exhaust port 138. The cigarette-engagement member 132 preferably is generally circular and will include a flexible sealing member around its inner circumference configured to form a preferably air-tight seal around an outer circumference around the proximal/mouth end 123 of the cigarette 120. An air-tight seal most preferably will enhance the efficiency of the lighter 100, and the presence of a flexible sealing member will allow the lighter 100 to accommodate smoking articles of different outer diameters and even non-circular outer profiles.

The fan member 134 preferably is a fan-type or other air-movement device configured to create a low-pressure area/partial vacuum proximal of the cigarette-engagement member 132. The fan member may be electrical (such as, for example, a small fan or vacuum pump, examples of which include those described in U.S. Pat. Nos. 4,780,062; 4,806,081; or 5,921,757), mechanical (such a miniature bellows, peristaltic pump, spring-wound fan), or any other type of device configured to create air flow that is sufficient to support ignition/combustion during an operation of the lighter.

When activated with a cigarette 120 positioned in the lighter 100 as shown in FIG. 1, the fan 134 will preferably provide air flow drawn through the cigarette 120 through the lighting end 121 (possibly with some ancillary air flow through the outer surface of the cigarette as many cigarettes include micro-perforations and/or paper with CORESTA values allowing air to be drawn through the wrapping material). The air flow drawn through the lighting end 121 will pass through the length and mouth end 123 of the cigarette 120, being drawn into and through the fan 134. As that air is expelled from the fan 134, it may be expelled directly out through an exhaust port. However, as shown in the embodiment of FIG. 1, it may be preferable to have that air directed from the fan through a filter member 136. A "vacuum" in the present application refers to providing an air flow through the smoking article that is sufficient to support ignition and combustion similar to a smoker lighting a smoking article in a traditional manner. In one example, sufficient air flow may include a draw of about 1 to about 5 seconds, more preferably about 2 to about 3 seconds, and most preferably about 2 seconds. The draw preferably moves about 15 to about 20 $cm^3$ of air per second, and commonly about 17.5 $cm^3$ of air per second, such that the total draw may be about 15 $cm^3$ to about 100 $cm^3$, but preferably is about 20 $cm^3$ to about 50 $cm^3$, and most typically is about 35 $cm^3$.

The filter member 136 may include mechanical filtration means such as fiber filtration (e.g., of a type similar to that found in cigarette filter tow) and/or chemical filtration means such as, for example, resins, activated charcoal, or other materials known to capture one or more aerosol components (such as, for example, PAHs including B[a]P) such that one or more of those components is reduced in the aerosol expelled through the exhaust port 138. As shown in FIG. 1, the fan member may be powered by the same power source 114 as the ignition element 110. The lighter 100 is shown with a button 126 configured to simultaneously actuate the ignition element 110 and the fan member 134 by providing power from the power source 114 to both. Those of skill in the art will appreciate that the button may alternatively be configured as a switch or some other actuation means already known in the art or developed in the future without departing from the scope of the present invention. For example, the cigarette-engagement aperture may include a pressure sensitive switch that activates the fan and the heating element when a cigarette is engaged into it, or the item designated as a "button" in the drawing figures of the various embodiments herein may be configured as a toggle switch, a pressure-sensitive electrode, a motion-activated sensor, or any other kind of switching/actuation means that may be located on the lighter wherever is most suitable for functionality, convenience, and safety. In a preferred embodiment, the lighter 100 comprises a patent fluid communication path between the mouth end 123 of the cigarette 120, the interior of the cigarette-engagement member 132, the fan 134, the filter member 136, and the exhaust port 138. It should be appreciated that the exhaust port of lighter embodiments within the scope of the present invention may be configured to vent into the body of the lighter. For example, a means for exerting a vacuum may include a small vacuum chamber in fluid communication with the exhaust port.

A method of use for the lighter 100 is here described with reference to FIG. 1. A user engages the mouth end 123 of a smoking article such as a cigarette 120 into the cigarette-engagement member 132 of a lighter 100. The user depresses the button 126 to activate the fan member 134 and the ignition element 110. The user adjusts the relative positions of the first and second body portions 102*a*, 102*b* such that the ignition element 110 contacts the lighting end 121 of the cigarette 120. When the lighting end 121 has been ignited, the user may remove the cigarette 120 from the lighter for his/her use. The step of depressing the button 126 to activate the fan member 134 and the ignition element 110 may be executed before, during, or after the step of adjusting the relative positions of the first and second body portions 102*a*, 102*b* such that the ignition element 110 contacts the lighting end 121 of the cigarette 120. In other words, the ignition element 110 may be heated to the point where it will ignite the lighting end 121 of the cigarette either before contact therewith, during initiation of contact therewith, or after it is already in contact therewith.

Figure 2:
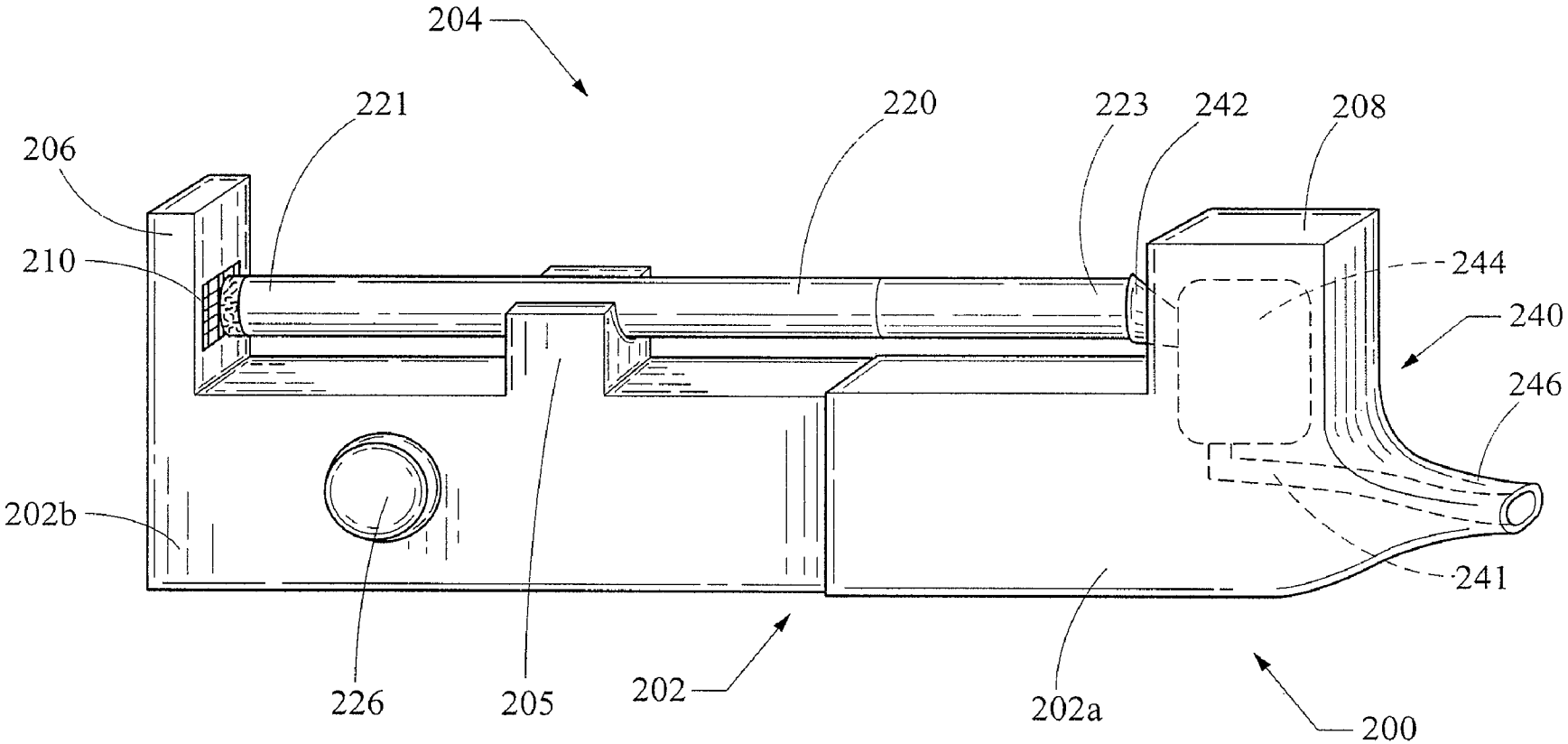
FIG. 2 is a perspective view of a second cigarette lighter embodiment.

FIG. 2 depicts a second embodiment of a lighter 200. The lighter 200 includes a one-piece body 202 having a proximal end region 202*a* and a distal end region 202*b*. A cigarette-receiving region 204 extends between upward-extending end portions 206, 208 of the proximal and distal end regions 202*a*, 202*b*.

A smoking article support 205 extends up from a central region of the body 202 into the cigarette-receiving region 204 and is configured to cradle or otherwise support a smoking article such as, for example, the cigarette 220 shown in FIG. 2. The upward-extending distal part 206 includes an ignition element 210 configured as an electrical lighting element connected to a power source (not shown).

The proximal end region 202*a* includes a filtration system 240. The filtration system 240 preferably includes a cigarette-engagement member 242, a filter member 244 and an exhaust lumen passage 241 passing through a mouthpiece 246. The cigarette-engagement member 242 preferably will include a flexible sealing member extending distally from the upward-extending portion 206 of the proximal end region 202*a* and configured to form a preferably air-tight seal around an outer circumference around the proximal/mouth end 223 of the cigarette 220 with a lumen providing fluid communication to the filter member 242. An air-tight seal most preferably will enhance the efficiency of the lighter 200, and the presence of a flexible sealing member will allow the lighter 200 to accommodate smoking articles of different outer diameters and of different lengths. In particular, the cigarette-engagement member 242 may be constructed of a sufficient length and/or flexibility to accommodate smoking articles of varied lengths and diameters.

This configuration allows a user to provide the vacuum for igniting a smoking article, but decreases the user's contact with certain components of the mainstream aerosol that may be present in higher concentrations in the first puff or first couple of puffs. When activated with a cigarette 220 positioned in the lighter 200 as shown in FIG. 2, the user may, by placing his/her mouth on the mouthpiece 246 and drawing air therethrough, provide air flow drawn through the lighting end 221 of the cigarette 220 (possibly with some ancillary air flow through the outer surface of the cigarette as many cigarettes include micro-perforations and/or paper with CORESTA values allowing air to be drawn through the wrapping material). The air flow drawn through the lighting end 221 will pass through the length and mouth end 223 of the cigarette 220, being drawn into and through a filter member 244. The filter member 244 may include mechanical filtration means such as fiber filtration (e.g., of a type similar to that found in cigarette filter tow) and/or chemical filtration means such as, for example, resins or other materials known to capture and reduce the downstream presence of one or more mainstream aerosol components (such as, for example, PAHs) such that one or more of those components is reduced in the aerosol drawn through the mouthpiece 246.

The lighter 200 is shown with a button 226 configured to actuate the ignition element 210. In certain embodiments, the filter 244 may be configured to include a porous resin, a fibrous mass, a sinuous series of air passages, a ciliated plurality of high-surface area passages, or other structures that will promote capture and reduction of certain mainstream aerosol components, most preferably without adversely affecting the flavor of the mainstream aerosol, so as not to reduce a user's enjoyment. In a preferred embodiment, the proximal end region 202*a* comprises a patent fluid communication path between the mouth end 223 of the cigarette 220, the lumen of the cigarette-engagement member 242, the filter member 244, and the mouthpiece 246.

A method of use for the lighter 200 is here described with reference to FIG. 2. A user engages the mouth end 223 of a smoking article such as a cigarette 220 into the cigarette-engagement member 242 of a lighter 200. The user depresses the button 226 to activate the ignition element 210. The user adjusts the relative positions of the cigarette 220 and the cigarette-engagement member 242 such that the lighting end 221 contacts the ignition element 210, and the user then creates a vacuum proximal of the engagement member 242 by drawing air through the mouthpiece 246. When the lighting end 221 has been ignited, the user may remove the cigarette 220 from the lighter for his/her use. The step of depressing the button 226 to activate the ignition element 210 may be executed before, during, or after the step of adjusting the relative positions of the cigarette-engagement member 242 and the cigarette 220.

Figure 3:
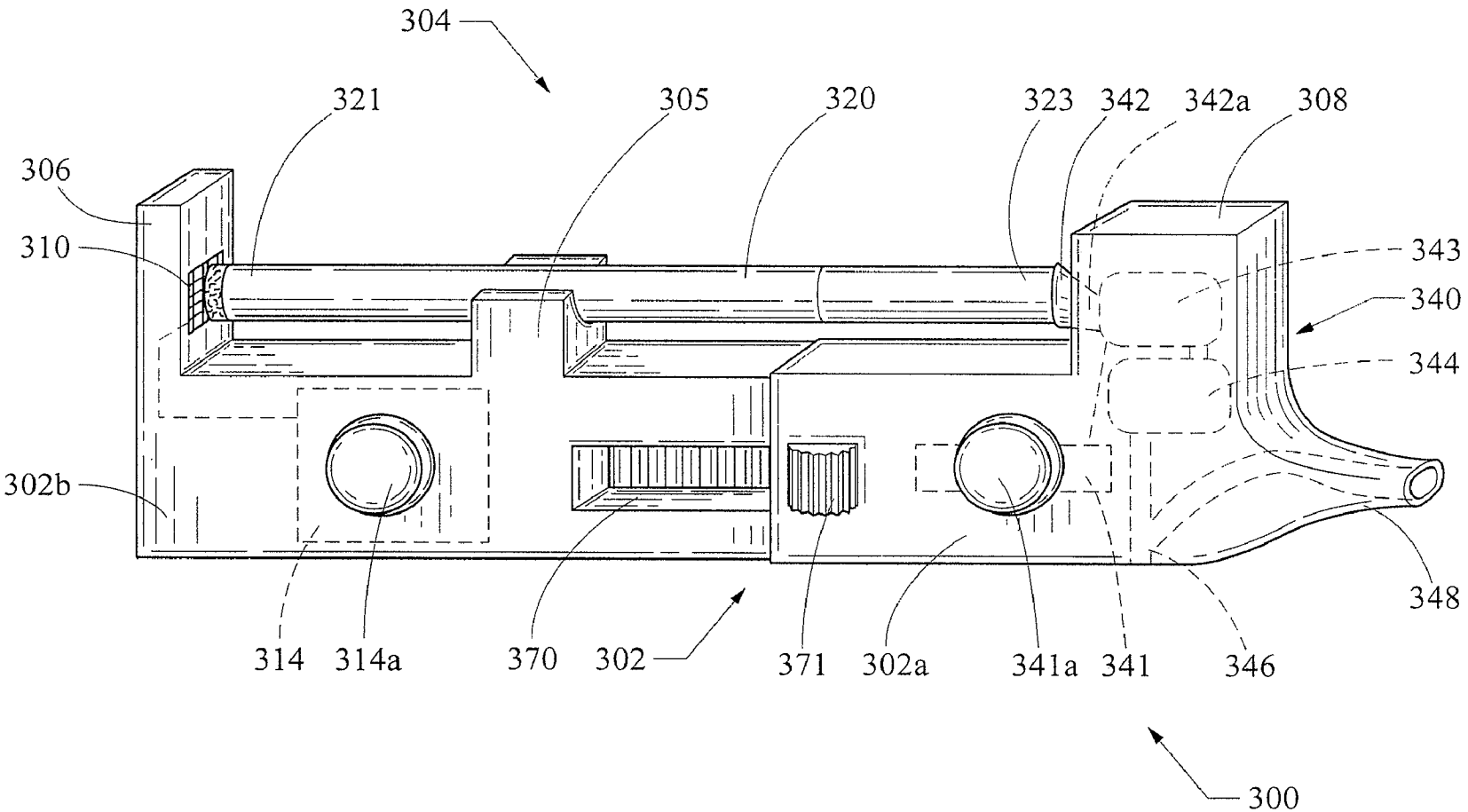
FIG. 3 is a perspective view of a third cigarette lighter embodiment.

FIG. 3 depicts a third embodiment of a lighter 300. The lighter 300 The lighter 300 includes a 2-piece body 302 having a first body portion 302*a* and a second body portion 302*b*. The first and second body portions 302*a*, 302*b* preferably are longitudinally positionable relative to each other in a manner configured to allow a user to change the length of the lighter 300 to accommodate smoking articles of different lengths such as, for example, different standard-length smoking articles or smoking articles that have been partially consumed. A cigarette-receiving region 304 extends between upward-extending end portions 306, 308 of the proximal and distal body portions 302*a*, 302*b*.

A smoking article support 305 extends up from a central region of the body 302 into the cigarette-receiving region 304 and is configured to cradle or otherwise support a smoking article such as, for example, the cigarette 320 shown in FIG. 3. The upward-extending distal part 306 includes an ignition element 310 connected to a first power source 314. The first power source 314 is shown with an actuation button 314*a* and is configured to power the ignition element 310.

The proximal end region 302*a* includes a three-way filtration system 340. The filtration system 340 includes a cigarette-engagement member 342, a fan member 343 (configured to provide a vacuum relative to the cigarette-engagement member 342), a filter member 344, an exhaust port 346, and a mouthpiece 348. A second power source 341 is shown with an actuation button 341 a and preferably is configured for powering the fan member 343. The cigarette-engagement member 342 preferably will include a flexible or otherwise adjustable-circumference sealing member configured to form a preferably air-tight seal around an outer circumference of the proximal/mouth end 323 of the cigarette 320 with a lumen 342*a* providing fluid communication to the filter member 344. An air-tight seal most preferably will enhance the efficiency of the lighter 300, and the presence of a sealing member will allow the lighter 300 to accommodate smoking articles of different outer diameters and of different lengths. In particular, the cigarette-engagement member 342 may be constructed of a sufficient length and/or flexibility to accommodate smoking articles of varied lengths, shapes, and/or diameters.

In the embodiment shown in FIG. 3, the distal body portion 302*b* includes a recessed region 370 configured to frictionally engage an outer surface of an adjustment wheel 371 mounted rotatingly in the proximal body portion 302*a*. It should be appreciated that, by rotating the adjustment wheel 371, a user may longitudinally position the proximal and distal body portions 302*a*, 302*b* relative to each other in a manner configured to accommodate smoking articles of different lengths. In an alternative embodiment, the adjustment wheel 371 may be spring-biased (e.g. by a coil spring) to rotate in a manner drawing the proximal and distal body portions 302*a*, 302*b* closer relative to each other. Such an embodiment preferably will facilitate maintaining a desirable contact between the ignition element 310 and the lighting end 321 of the cigarette 320 without undesirably longitudinally compressing the cigarette 320.

This configuration includes three potential methods of use, each described below with reference to the lighter embodiment 300 of FIG. 3, for a user to provide a vacuum for igniting a smoking article, while decreasing the user's contact with certain components of the mainstream aerosol that are present in higher concentrations in the first puff or first couple of puffs. In each of the cigarette-lighting methods described, the user may begin with a cigarette 320 positioned in the lighter 300 as shown in FIG. 3. The user may then provide air flow drawn through the cigarette 320 through the lighting end 321 (possibly with some ancillary air flow through the outer surface of the cigarette as many cigarettes include micro-perforations and/or paper with CORESTA values allowing air to be drawn through the wrapping material). The air flow drawn through the lighting end 321 will pass through the length and mouth end 323 of the cigarette 320, being drawn into and through a filter member 344. The filter member 344 may include mechanical filtration means such as fiber filtration (e.g., of a type similar to that found in cigarette filter tow) and/or chemical filtration means such as, for example, resins or other materials known to capture and reduce the downstream presence of one or more mainstream aerosol components (such as, for example, PAH and B[a]P) such that one or more of those components is reduced in the aerosol that exits downstream of the filter 344.

In a first method, the airflow is drawn by the user through the mouthpiece 348, preferably using the exhaust port 346 as a carburetor through which airflow is limited or blocked by, for example, a finger of the user. In a second method, a user may expel air into the mouthpiece 348 and out through the exhaust port 346, which will create a vacuum in the fan/filter region and thereby provide the air flow through the cigarette 320 as described above. In a third method, a user may activate the fan member 343 by actuating the button 343*a* (which may alternatively be embodied as a switch or other actuation means) in order to create a vacuum and desired air flow. During any of these methods, the user will preferably actuate the ignition element 310 by use of the actuation button 314*a* (which also may alternatively be embodied as a switch or other actuation means). The step of activating the ignition element 310 may be executed during any of the above-described methods for providing a vacuum to create desired air flow. As with other lighter embodiments described herein, the filter 344 may be configured to include a porous resin, a fibrous mass, a sinuous series of air passages, a ciliated plurality of high-surface area passages, and/or other structures that will promote capture and reduction of certain mainstream aerosol components, most preferably without adversely affecting the flavor of the mainstream aerosol, so as not to reduce a user's enjoyment.

A general method of using a lighter of the present invention may include the steps of: providing a lighter including a distal ignition means and a proximal means for exertion of a vacuum upon a smoking article; placing a smoking article with its lighting end proximate the distal ignition means and its mouth end in fluid communication with the proximal means for exertion of a vacuum; actuating the proximal means for exertion of a vacuum and the distal ignition means until the lighting end is ignited; and removing the smoking article from the lighter for consumption by a smoker. The lighting end may contact the distal ignition means, or it may just be near enough to be ignited (e.g., if the ignition means is an electronic element, it may be preferable to have physical contact, while proximity may be sufficient if the ignition means uses a flame).

It should be appreciated, that lighter embodiments of the present invention are not configured as smoking devices. Rather, the most preferred method of use for all embodiments of the present invention includes the user lighting a single smoking article, then removing the smoking article from the lighter as soon as it is lit, for his/her own use. Preferred embodiments of the device will be sized to be portable (e.g., able to fit easily into a shirt pocket, purse, etc.).

A lighter of the present invention may be constructed of materials that are durable and configured for long-time use. For example, the lighter may be configured such that one or more of the power source, filter member, fan member, and cigarette-engagement member are replaceable while keeping and re-using the rest of the lighter structure. For example, the lighter may be constructed to use a power source that is a readily available DC battery, and/or one or more of the cigarette-engagement member, fan member, and filter member may be provided in a removable/replaceable cartridge construction. Alternatively, the lighter may be constructed of materials that are less durable but also less expensive such that the lighter and/or its various components may be recyclable or disposable. Each of the embodiments illustrated includes an internal power source, but it should be appreciated than embodiments not including an internal power source may be practiced within the scope of the present invention. For example, power for heating the ignition element may be provided from an external power source, such as, for example, a DC or AC power source.

Various types of smoking articles may be used with a lighter of the present invention, and hence, can be lit using such a lighter. Representative smoking articles include various types of cigarettes (including various types of cigarette components, including different tobacco types, tobacco blends, top dressing and casing materials, paper wrapping materials for tobacco rods, and filter elements). See, for example, the various representative types of cigarette components, as well as the various cigarette designs, formats, configurations and characteristics, that are set forth in Johnson, Development of Cigarette Components to Meet Industry Needs, 52nd T.S.R.C. (September 1998); U.S. Pat. No. 5,101,839 to Jakob et al.; U.S. Pat. No. 5,159,944 to Arzonico et al.; U.S. Pat. No. 5,220,930 to Gentry and U.S. Pat. No. 6,779,530 to Kraker; and U.S. Patent Publication Nos. 2005/0016556 to Ashcraft et al.; 2005/0066986 to Nestor et al.; 2005/0076929 to Fitzgerald et al.; 2007/0006888 to Hicks et al.; 2007/0056600 to Coleman, III et al.; 2007/0068540 to Thomas et al.; 2007/0246055 to Oglesby; and 2008/0078417 to Wanna et al.; each of which is incorporated herein by reference. Most preferably, the entire smokable rod is composed of smokable material (e.g., tobacco cut filler) and a layer of circumscribing outer wrapping material. Alternatively, the cigarette can be of the type set forth in U.S. Patent Application 2007/002115167 to Crooks et al., which is incorporated herein by reference in its entirety.

Many modifications and other aspects of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific aspects disclosed and that modifications and other aspects are intended to be included within the scope of the appended claims. Although specific terms are employed herein, they are used in a generic and descriptive sense only and not for purposes of limitation.

I claim:

1. A lighter for a smoking article, comprising:

a body having a distal body portion and a proximal body portion;

an ignition element disposed in the distal portion;

a smoking article engagement structure disposed in the proximal body portion;

a part of the proximal body portion configured for exerting a vacuum upon a smoking article retained by the smoking article engagement structure; and an exhaust port in fluid communication with the part of the proximal body portion configured for exerting a vacuum;

wherein the proximal and distal body portions are longitudinally positionable relative to each other; and wherein one of the proximal and distal body portions comprises an adjustment wheel in frictional contact with the other of the proximal and distal body portions and configured to change the relative longitudinal positions of the proximal and distal body portions when actuated.

2. The lighter of claim 1, wherein the proximal and distal body portions are biased toward each other.

3. The lighter of claim 1, further comprising an indented portion of the other of the proximal and distal body portions configured to receive at least a portion of the adjustment wheel.

4. The lighter of claim 1, wherein the part of the proximal portion configured for exerting a vacuum comprises a fan.

5. The lighter of claim 4, further comprising an actuation member configured for actuating the fan.

6. The lighter of claim 5, wherein the actuation member is further configured for actuating the ignition element.

7. The lighter of claim 4, further comprising a power source configured in electrical communication with a selected one or both of the fan and the ignition element.

8. The lighter of claim 1, wherein the part of the proximal body portion configured for exerting a vacuum comprises a mouthpiece.

9. The lighter of claim 1, further comprising a filter member configured to reduce at least one component of a mainstream aerosol.

10. The lighter of claim 1, further comprising a patent path of fluid communication between the smoking article engagement structure, the part of the proximal portion configured for exerting a vacuum, and the exhaust port.

11. The lighter of claim 10, wherein patency of the path of fluid communication is controllable by a user.

12. The lighter of claim 1, further comprising a power source in electronic communication with the ignition element.

13. The lighter of claim 1, further comprising a support member disposed on the body between the ignition element and the smoking article engagement structure, the support member configured to support a smoking article aligned between the ignition element and the smoking article engagement structure.

14. The lighter of claim 1, further comprising an actuation member in communication with the ignition element and configured for actuating the ignition element.

15. The lighter of claim 1, wherein the ignition element comprises an electrical ignition element.

16. The lighter of claim 1, wherein the smoking article engagement structure is configured to form a fluid-tight seal around an outer circumference of a smoking article.

17. A lighter for a smoking article, comprising:

a body having a distal body portion and a proximal body portion that are longitudinally positionable relative to each other;

an ignition element disposed in the distal portion;

a smoking article engagement structure disposed in the proximal body portion;

an exhaust port member comprising a mouthpiece element connected with the proximal body portion in fluid communication with the smoking article engagement structure and configured for exertion of a vacuum upon a smoking article retained by the smoking article engagement structure;

an exhaust port in fluid communication with the mouthpiece and the smoking article engagement structure; and a fan member disposed between the smoking article engagement structure and the mouthpiece element;

wherein one of the proximal and distal body portions comprises an adjustment wheel in frictional contact with the other of the proximal and distal body portions and configured to change the relative longitudinal positions of the proximal and distal body portions when actuated.

18. The lighter of claim 17, further comprising a filter member configured to reduce at least one component of a mainstream aerosol.

19. The lighter of claim 17, wherein the proximal and distal body portions are biased toward each other.

20. The lighter of claim 17, further comprising an indented portion of the other of the proximal and distal body portions configured to receive at least a portion of the adjustment wheel.

21. A method of lighting a smoking article, the method comprising the steps of:

providing a lighter according to claim 1;

placing a smoking article including a lighting end and a mouth end with the lighting end proximate the distal ignition element and the mouth end in fluid communication with the proximal body portion configured for exerting a vacuum;

actuating the proximal body portion configured for exerting a vacuum and the distal ignition element until the lighting end is ignited; and removing the smoking article from the lighter for consumption by a smoker.

22. The method of claim 21, wherein the the step of placing a smoking article further comprises positioning the mouth end of the smoking article into at least a partial engagement with the engagement structure.

23. The method of claim 21, wherein the proximal body portion configured for exerting a vacuum comprises a fan member, and the step of actuating the proximal body portion configured for exerting a vacuum further comprises activating the fan member.

24. The method of claim 21, wherein the proximal body portion configured for exerting a vacuum comprises a filter and a mouthpiece, and the step of actuating the proximal body portion configured for exerting a vacuum further comprises a smoker drawing air through the smoking article, the filter, and the mouthpiece.

* * * * *